United States Patent [19]

Nishikawa et al.

[11] Patent Number: 4,517,947

[45] Date of Patent: May 21, 1985

[54] MULTIPLE CYLINDER ENGINE HAVING AIR-FUEL RATIO CONTROL MEANS IN ACCORDANCE WITH A SIGNAL FROM AN EXHAUST GAS SENSOR

[75] Inventors: Toshio Nishikawa; Tadashi Kaneko; Kazutoshi Othuka, all of Hiroshima, Japan

[73] Assignee: Mazda Motor Corporation, Hiroshima, Japan

[21] Appl. No.: 355,451

[22] Filed: Mar. 8, 1982

[30] Foreign Application Priority Data

Mar. 9, 1981 [JP] Japan ..... 56-34385

[51] Int. Cl.[3] ..... F02M 51/00

[52] U.S. Cl. ..... 123/489; 123/52 MF; 123/443

[58] Field of Search ..... 123/52 MF, 198 F, 323, 123/443, 440, 489

[56] References Cited

U.S. PATENT DOCUMENTS

| | | | |
|---|---|---|---|
| 3,814,069 | 6/1974 | Croft et al. | 123/52 MF |
| 3,910,240 | 10/1975 | Omori et al. | 123/443 |
| 4,114,374 | 9/1978 | Tanahashi | 123/198 F |
| 4,357,828 | 11/1982 | Nakawo | 123/440 |
| 4,401,081 | 8/1983 | Wessel et al. | 123/489 |

FOREIGN PATENT DOCUMENTS

| | | | |
|---|---|---|---|
| 47125 | 4/1977 | Japan | 123/443 |
| 48739 | 4/1977 | Japan | 123/443 |

*Primary Examiner*—Parshotam S. Lall
*Assistant Examiner*—W. R. Wolfe
*Attorney, Agent, or Firm*—Fleit, Jacobson, Cohn & Price

[57] ABSTRACT

A multiple cylinder engine including a first group of cylinders having a first intake passage which is provided with a air-fuel mixture of a predetermined ratio in accordance with the signal from an exhaust gas sensor provided in the exhaust passage from the first group of cylinders. The engine further includes a second group of cylinders having a second intake passage which is provided with a mixture having an air-fuel ratio which is of a predetermined relationship with respect to the air-fuel ratio of the mixture provided to the first group of cylinders, the predetermined relationship being determined in accordance the engine operating condition. Check valves are provided in the intake passages to prevent the mixture in the first intake passage from being mixed with that in the second intake passage so that accurate control can be ensured.

8 Claims, 3 Drawing Figures

MULTIPLE CYLINDER ENGINE HAVING AIR-FUEL RATIO CONTROL MEANS IN ACCORDANCE WITH A SIGNAL FROM AN EXHAUST GAS SENSOR

The present invention relates to internal combustion engines and more particularly to means for controlling the air-fuel ratio in a multiple cylinder engine. More specifically, the present invention pertains to air-fuel ratio control means for a multiple cylinder engine in which the air-fuel ratio is controlled in accordance with a signal from an exhaust gas sensing means.

In internal combustion engines, it has been known to control air-fuel ratio of the intake mixture by means of an exhaust gas sensor which detects the concentration of a specific constituent of the exhaust gas to produce an output signal so that the fuel control system is controlled in accordance with the output signal of the exhaust gas sensor to establish a desired air-fuel ratio of the intake mixture. This type of control system is usually designed so as to accomplish an air-fuel ratio at or close to the stoichiometric value, which is approximately 14.7 in case of gasoline, and the exhaust system is provided with a ternary catalytic device to eliminate noxious constituents in the exhaust gas.

Usually, the exhaust gas sensor is a so-called $O_2$ sensor which is known as having an output that significantly changes in the vicinity of the air-fuel ratio of 14.7. The $O_2$ sensor is therefore very convenient to perform accurate control when it is desired to obtain an air-fuel ratio at or close to the stoichiometric value. However, it is very often desirable to obtain a richer or leaner mixture, depending on the engine operating conditions. For example, a richer mixture is desirable under a light load or heavy load operation or under a low temperature condition in order to obtain stable engine operation. Further, a leaner mixture may be desirable under steady engine operation for the purpose of obtaining improved fuel economy. The $O_2$ sensor usually adopted as the exhaust gas sensor is however inconvenient for such control because the change in the output of the sensor for a change in the air-fuel ratio becomes small under a richer or leaner air-fuel ratio.

In order to solve the aforementioned problems in the air-fuel ratio control system using an $O_2$ sensor, there is proposed in Japanese Patent Publication No. 54-35258 to control, in a multiple cylinder engine, the air-fuel ratio for one cylinder in accordance with the output of the exhaust gas sensor and the air-fuel ratio for the other cylinders with respect to the air-fuel ratio for the one cylinder so that the air-fuel ratio can be changed as a whole with respect to the stoichiometric value.

The present invention has as an object to provide an air-fuel ratio control device for a multiple cylinder engine in which accurate control of air-fuel ratio can be ensured.

Another object of the present invention is to provide an air-fuel ratio control device for a multiple cylinder engine in which accurate control to any desired value of air-fuel ratio can be performed.

According to the present invention, the above and other objects can be accomplished by a multiple cylinder internal combustion engine including first group of cylinder means, second group of cylinder means, an intake system comprising main intake passage means, first intake passage means branched from said main intake passage means and leading to said first group of cylinder means and, second intake passage means branched from said main intake passage means and leading to said second group of cylinder means, first fuel supply means for providing a supply of fuel to said first intake passage means, second fuel supply means for providing a supply of fuel to said second intake passage means, first exhaust passage means leading from said first group of cylinder means for passing exhaust gas therefrom, exhaust gas sensing means disposed in said first exhaust passage means for providing an output signal in accordance with the concentration of a constituent in the exhaust gas, first air-fuel ratio control means for controlling the first fuel supply means in accordance with the output of the exhaust gas sensing means so as to provide a first intake mixture of a first predetermined air-fuel ratio, second air-fuel ratio control means for controlling the second fuel supply means in accordance with the first predetermined air-fuel ratio to provide a second intake mixture of a second air-fuel ratio which is a predetermined relationship with respect to the first air-fuel ratio and, mixing preventing means provided in said intake system for preventing said first and second intake mixtures from being mixed with each other due to pulsations in said intake system. The mixing preventing means may be in the form of check valve means which may be of a reed type. Alternatively, it may be provided by expansion chamber means.

The second air-fuel ratio control means may include detecting means for detecting an engine operating condition and adjusting means for determining a compensation ratio which is the ratio of the second predetermined air-fuel ratio to the first predetermined air-fuel ratio in accordance with the engine operating condition. In one aspect of the present invention, the engine operating condition is the engine temperature and the second intake mixture is enriched under cold engine operation. In another aspect, the engine operating condition is the engine load so that the second intake mixture is enriched under light load or heavy load engine operation.

The first and second groups of cylinder means may have the same number of cylinders, respectively, and each of said first and second intake passage means may include a manifold passage and branch passages leading from said manifold passage and communicating with the respective ones of the cylinders, said mixing preventing means being provided in said manifold passage. The first and second fuel supply means may include fuel injection valve means and the first and second air-fuel ratio control means may include circuit means which control duration of fuel injection in accordance with the engine operating condition and the output of the exhaust gas sensing means.

The second group of cylinder means may have second exhaust passage means which is merged with said first exhaust passage means, at least said first exhaust passage means having back flow preventing means downstream of said exhaust gas sensing means.

The above and other objects and features of the present invention will become apparent from the following descriptions of preferred embodiments taking reference to the accompanying drawings, in which.

Figure 1:
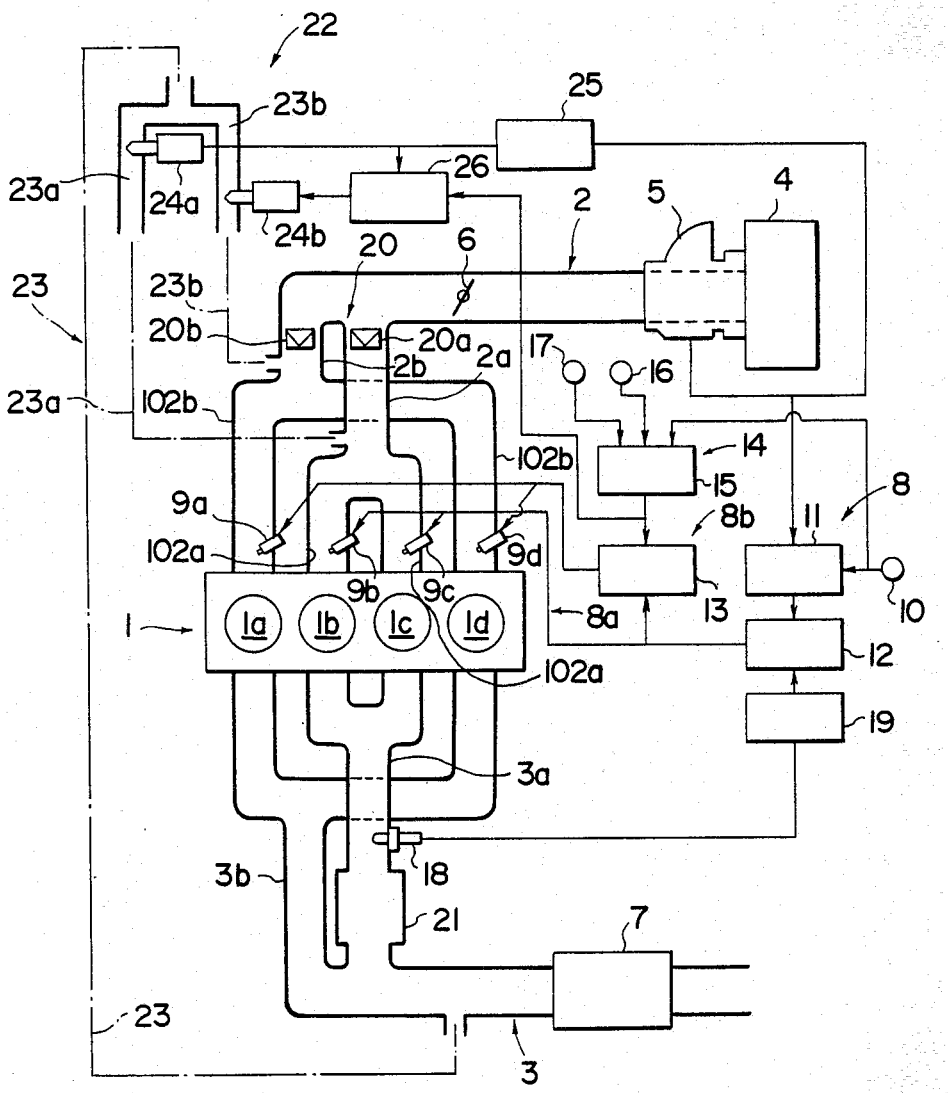
FIG. 1 shows schematically a multiple cylinder engine in accordance with one embodiment of the present invention.

Referring now to the drawings, particularly to FIG. 1, there is shown a four cylinder engine 1 having cylinders 1*a*, 1*b*, 1*c* and 1*d*. The engine has an intake system including a main intake passage 2 which is branched into intake passages 2*a* and 2*b*. The intake passage 2*a* is connected through branch passages 102*a* with the cylinders 1*b* and 1*c*, whereas the intake passage 2*b* is connected through branch passages 102*b* with the cylinders 1*a* and 1*d*. The cylinders 1*b* and 1*c* are not adjacent to each other in respect of the order of combustion and the cylinders 1*a* and 1*d* are not adjacent to each other in respect of the order of combustion. The engine further has an exhaust system including an exhaust passage 3*a* leading from the cylinders 1*b* and 1*c* and an exhaust passage 3*b* leading from the cylinders 1*a* and 1*d*. The exhaust passages 3*a* and 3*b* are merged into an exhaust manifold 3 which has a catalytic converter 7 disposed therein.

The main intake passage 2 is provided at the upstream end with an air cleaner 4. A throttle valve 6 is provided in the main intake passage 2 to control the air flow into the cylinders. The engine is equipped with a fuel supply system 8 which includes fuel injection valves 9*a*, 9*b*, 9*c* and 9*d* which are associated respectively with the branch intake passages. An air flowmeter 5 is provided in the main intake passage 2 between the air cleaner 4 and the throttle valve 6 and produces an air flow signal to an oscillator 11. An engine speed sensor 10 is provided to detect the engine speed and applies an engine speed signal to the oscillator 11. The oscillator 11 produces a pulsating output of which pulse width is determined in accordance with the air flow signal and the engine speed signal to control the amount of fuel supply in one operating cycle. The output pulse of the oscillator 11 is applied to a processing circuit 12.

The exhaust passage 3*a* is provided with an exhaust gas sensor 18 such as an $O_2$ sensor which applies an output to an air-fuel ratio adjusting circuit 19 which produces an adjusting signal to apply it to the processing circuit 12. The processing circuit 12 produces an output pulse of which pulse width is determined in accordance with the pulse width of the output from the oscillator 11 and the signal from the circuit 19. The output of the circuit 12 is applied to the fuel injection valves 9*b* and 9*c* which are provided in the branch intake passages 102*a* to control the duration of fuel injection through these valves. It should be noted that the fuel injection valves 9*b* and 9*c* constitute a first fuel supply device 8*a* and the control through the processing circuit 12 of the first fuel supply device 8*a* produces an air-fuel mixture having mixing ratio at or close to the stoichiometric value.

The output of the processing circuit 12 is also applied to a pulse modifying circuit 13 which produces an output for controlling a second fuel supply device 8*b* constituted by the fuel injection valves 9*a* and 9*d*. There are provided an engine temperature sensor 16 and an intake suction pressure sensor 17 which produce output signals to be applied to a modifying oscillator 15 which constitutes an air-fuel ratio modifying device 14. The output from the engine speed sensor 10 is also applied to the oscillator 15. The oscillator 15 produces a modifying signal in accordance with the engine operating conditions which is judged by the signals from the sensors 10, 16 and 17. The modifying signal is applied to the pulse modifying circuit 13 to modify the width of the pulse from the processing circuit 12 in accordance with the engine operating condition. Thus, the fuel ratio modifying device 14 functions to enrich the mixture supplied to the cylinders 1*a* and 1*d* under cold engine operation or under a light load or heavy load operation to ensure stable engine operation whereas a mixture of the stoichiometric ratio is supplied to the cylinders 1*a* and 1*d* under a medium load operation. Further, a leaner mixture may be supplied to the cylinders 1*a* and 1*d* under steady engine operation.

The intake system is further provided with an exhaust gas recirculation system 22 including a recirculation passage 23 extending from the exhaust manifold 3. The passage 23 opens into branch passages 23*a* and 23*b*, respectively, with the intake passages 2*a* and 2*b*. In the passages 23*a* and 23*b*, there are respectively provided control valves 24*a* and 24*b* which may be proportional solenoid valves of which the openings are propositioned with electric current applied thereto. In order to control the current to the valves 24*a* and 24*b*, there is provided a valve driving circuit 25 which receives the output signal from the air flow sensor 5 and produces an output signal for determining the amount of recirculation gas to be introduced into the cylinders 1*b* and 1*c*. The signal from the driving circuit 25 is therefore directly applied to the control valve 24*a*. The output from the driving circuit 25 is further applied to a modifying circuit 26 which also receives the signal from the oscillator 15 to produce a modified signal for energizing the control valve 24*b*. The exhaust gas recirculation system 22 therefore functions to control the amount of recirculation gas in accordance with the air-fuel ratio so that a larger amount of gas is recirculated when a richer mixture is being supplied.

Figure 2:
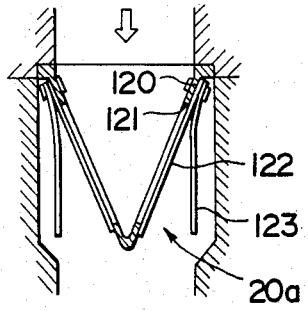
FIG. 2 is a sectional view in an enlarged scale of a check valve used in the engine shown in FIG. 1.

In the intake system, there is also provided a mixing preventing device 20 which comprises, in this embodiment, a first and second check valves 20*a* and 20*b* respectively located in the intake passages 2*a* and 2*b*. As shown in FIG. 2, the check valve 20*a* is of a reed type including a valve body 120 formed with openings 121 and valve members 122 adapted to close the openings 121. Stoppers 123 are provided to limit the open positions of the valve members 122. The check valve 20*b* has the same structure as the check valve 20*a*.

In the exhaust passage 3*a*, there is formed downstream of the exhaust gas sensor 18 an expansion chamber 21 which serves to prevent back flow of the exhaust gas into the exhaust passage 3*a*.

In the arrangement described above, the mixture to be supplied to the cylinders 1*b* and 1*c* is maintained substantially at a predetermined air-fuel ratio, for example at the stoichiometric ratio, due to the feedback control using the signal from the exhaust gas sensor 18. The mixture to the cylinders 1*a* and 1*d* is modified in accordance with the engine operating condition to adjust the air-fuel ratio as a whole.

The chech valves 20*a* and 20*b* provided in the intake passages 2*a* and 2*b* function to prevent the mixtures in the passages 2*a* and 2*b* from being mixed with each other due to pulsations in the intake passages. Thus, it is possible to maintain the air-fuel ratio of the mixture to be supplied to the cylinders 1*b* and 1*c* accurately at the predetermined value and at the same time to control the air-fuel ratio of the mixture to the cylinders 1*a* and 1*d* at a desired value. In the illustrated embodiment, the branch intake passages 102*a* and 102*b* are connected with the main intake passage 2 through the intake passages 2*a* and 2*b*, respectively. However, the passages 102*a* and 102*b* may be connected directly with the main intake passage 2. In that case, the check valves are located in the branch passages 102*a* and 102*b*.

Figure 3:
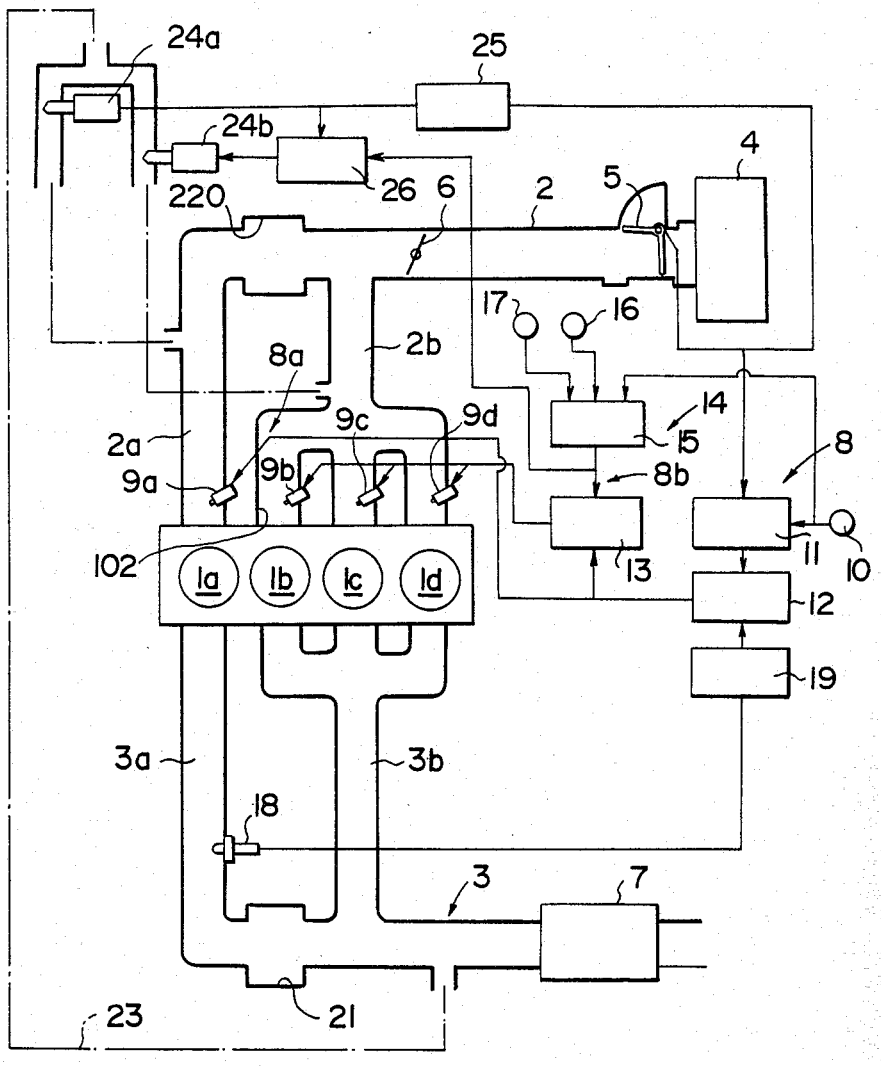
FIG. 3 is a view similar to FIG. 1 but showing another embodiment.

Referring now to FIG. 3, there is shown another embodiment of the present invention. In this embodiment, corresponding parts are shown by the same reference numerals as in the previous embodiment. In this embodiment, the main intake passage 2 is connected through an intake passage 2*a* with a first cylinder 1*a* and through an intake passsge 2*b* and branch passages 102 with the other cylinders 1*b*, 1*c*, and 1*d*. In the intake passage 2*a*, there is formed an expansion chamber 220 which functions to absorb pulsations in the intake system to thereby prevent the mixture in the passage 2*a* from being mixed with that in the passage 2*b*.

The invention has thus been shown and described with reference to specific embodiments, however, it should be noted that the invention is in no way limited to the details of the illustrated arrangements, but changes and modifications may be made without departing from the scope of the appended claims.

We claim:

1. A multiple cylinder internal combustion engine including a first group of cylinder means, a second group of cylinder means, an intake system comprising main intake passage means, first intake passage means branched from said main intake passage means and leading to said first group of cylinder means, second intake passage means branched from said main intake passage means and leading to said second group of cylinder means, first fuel supply means for providing a supply of fuel to said first intake passage means, second fuel supply means for providing a supply of fuel to said second intake passage means, first exhaust passage means leading from said first group of cylinder means for passage of exhaust gas therefrom, exhaust gas sensing means including an oxygen concentration detecting means disposed in said first exhaust passage means for providing an output signal in accordance with the concentration of oxygen in the exhaust gas, first air-fuel ratio control means for controlling the first fuel supply means in accordance with the output of the exhaust gas sensing means so as to provide a first intake mixture of a first predetermined air-fuel ratio, second air-fuel ratio control means for controlling the second fuel supply means in accordance with the first predetermined air-fuel ratio to provide a second intake mixture of a second air-fuel ratio which is a predetermined relationship with respect to the first air-fuel ratio, mixing preventing means provided in said intake system upstream of said first and second fuel supply means for preventing said first and second intake mixtures from being mixed with each other due to pulsations in said intake system, and second exhaust passage means extending from said second group of cylinder means and merged with the first exhaust passage means, said first exhaust passage means being provided downstream of the exhaust gas sensing means with backflow preventing means.

2. An engine in accordance with claim 1 in which said mixing preventing means comprises check valve means.

3. An engine in accordance with claim 1 in which said mixing preventing means comprises expansion chamber means.

4. An engine in accordance with claim 1 in which said first and second groups of cylinder means have the same number of cylinders, the cylinders in each group having branched intake passages which are merged into an intake passage, said mixing preventing means being provided in said intake passage in said first group, each group of cylinder means including cylinders which are not adjacent to each other in respect of the order of combustion.

5. An engine in accordance with claim 1 in which said first and second fuel supply means comprise fuel injection valve means, said first air-fuel ratio control means including circuit means for providing output pulses the width of which is determined in accordance with an engine operating condition signal and the output of the exhaust gas sensing means, said second air-fuel ratio control means including modifying circuit means for modifying the output pulses of the circuit means in the first air-fuel ratio control means.

6. An engine in accordance with claim 1 in which said second air-fuel ratio control means includes engine operating condition sensing means for producing an engine operating condition signal and modifying means for determining said predetermined relationship between the first and second air-fuel ratios in accordance with the engine operating condition signal.

7. An engine in accordance with claim 6 in which said engine operating condition sensing means includes engine temperature sensing means, said modifying means being adapted to determine the predetermined relationship so that said second intake mixture is enriched when the engine temperature is below a warmed-up temperature.

8. An engine in accordance with claim 6 in which said engine operating condition sensing means includes engine load sensing means so that said second intake mixture is enriched under light load and heavy load engine operation.

* * * * *